US010805756B2

(12) United States Patent
Di Censo et al.

(10) Patent No.: US 10,805,756 B2
(45) Date of Patent: Oct. 13, 2020

(54) TECHNIQUES FOR GENERATING MULTIPLE AUDITORY SCENES VIA HIGHLY DIRECTIONAL LOUDSPEAKERS

(71) Applicant: Harman International Industries, Incorporated, Stamford, CT (US)

(72) Inventors: Davide Di Censo, Oakland, CA (US); Stefan Marti, Oakland, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/744,761

(22) PCT Filed: Jul. 14, 2015

(86) PCT No.: PCT/US2015/040462
§ 371 (c)(1),
(2) Date: Jan. 12, 2018

(87) PCT Pub. No.: WO2017/010999
PCT Pub. Date: Jan. 19, 2017

(65) Prior Publication Data

US 2018/0206055 A1 Jul. 19, 2018

(51) Int. Cl.
*H04S 7/00* (2006.01)
*H04R 3/12* (2006.01)
(Continued)

(52) U.S. Cl.
CPC ..... *H04S 7/303* (2013.01); *H04R 1/403* (2013.01); *H04R 3/12* (2013.01); *H04R 5/023* (2013.01);
(Continued)

(58) Field of Classification Search
CPC combination set(s) only.
See application file for complete search history.

(56) References Cited

U.S. PATENT DOCUMENTS 8,358,999 B1 * 1/2013 Vu ..... H04W 4/10 455/404.1
9,747,901 B1 * 8/2017 Gentry ..... G10L 15/22
(Continued)

FOREIGN PATENT DOCUMENTS

WO 2012122132 A1 9/2012

OTHER PUBLICATIONS

International Search Report Application No. PCT/US2015/040462, dated Mar. 8, 2016, 8 pages.

*Primary Examiner* — Duc Nguyen
*Assistant Examiner* — Assad Mohammed
(74) *Attorney, Agent, or Firm* — Artegis Law Group, LLP

(57) ABSTRACT

In one embodiment of the present invention, a central communications controller creates customized hearing experiences without unnecessarily encumbering listeners. In operation, for each listener, the central communications controller selects distracting and/or confidential sounds and generates a cancellation signal that substantially attenuates (i.e., "cancels out") the selected sounds without corrupting remaining sounds. To selectively filter the sounds for a listener, the central communications controller leverages one or more highly directional loudspeakers to deliver the cancellation signal directly to the ears corresponding to the listener. More specifically, for a given ear, the central communications controller transmits the cancellation signal to a highly direction loudspeaker that targets the location of the ear. In this fashion, the central communications controller provides a listener-customized listening experience—selectively cancelling sounds at Identify sounds to be suppressed and generate ears—without relying on constraining sound delivery systems such as headphones, in-ear auditory devices, and the like.

20 Claims, 10 Drawing Sheets

(51) Int. Cl.
*H04R 5/02* (2006.01)
*H04R 1/40* (2006.01)
*H04R 27/00* (2006.01)

(52) U.S. Cl.
CPC ..... *H04R 27/00* (2013.01); *H04R 2217/03* (2013.01); *H04R 2227/003* (2013.01); *H04R 2420/07* (2013.01); *H04R 2499/13* (2013.01)

(56) References Cited

U.S. PATENT DOCUMENTS

2006/0262935 A1* 11/2006 Goose ..... H04S 3/002 381/17
2011/0103620 A1 5/2011 Strauss et al.
2013/0058503 A1* 3/2013 Kato ..... H04R 3/04 381/107
2013/0077803 A1* 3/2013 Konno ..... H04R 1/323 381/107
2013/0089219 A1* 4/2013 Allen ..... G10K 11/178 381/97
2013/0321625 A1* 12/2013 Yanagihara ..... H04R 1/32 348/143
2014/0254811 A1* 9/2014 Takeda ..... H04S 7/303 381/58
2014/0270321 A1* 9/2014 Fullam ..... H04R 1/028 381/387
2015/0189457 A1 7/2015 Donaldson
2015/0382129 A1* 12/2015 Florencio ..... H04S 1/002 381/303

* cited by examiner

TECHNIQUES FOR GENERATING MULTIPLE AUDITORY SCENES VIA HIGHLY DIRECTIONAL LOUDSPEAKERS

CROSS-REFERENCE TO RELATED APPLICATIONS

The present application is a national stage application of the international application titled, "TECHNIQUES FOR GENERATING MULTIPLE AUDITORY SCENES VIA HIGHLY DIRECTIONAL LOUDSPEAKERS," filed on Jul. 14, 2015 and having application number PCT/US2015/040462. The subject matter of this related application is hereby incorporated herein by reference.

BACKGROUND

Field of the Invention

Embodiments of the present invention relate generally to audio systems and, more specifically, to techniques for generating multiple auditory scenes via highly directional loudspeakers.

Description of the Related Art

In various situations, people often find a need or desire to engage in a private conversation while in the presence of others. Further, people also try to limit such private conversations in public settings in an effort to avoid distracting other people. For example, a person participating in a meeting could receive an important phone call during the meeting. In order to prevent other people present at the meeting from overhearing the phone call and/or to avoid disrupting the meeting, the person receiving the call could choose to leave the room to take the call or not take the call at all. In another example, a person riding in a vehicle could desire to make a telephone call without the other passengers in the vehicle overhearing the call and/or without disrupting conversation among the other passengers in the vehicle. In such a case, the person could initiate the call and speak in a hushed voice or wait and make the call in private at a later time. In yet another example, the main conversation in a group meeting could give rise to a need for a sidebar conversation among a subset of the meeting participants. In such a case, the subset of meeting participants could adjourn to another meeting room, if another meeting room is available, or could defer the sidebar conversation until later when there is more privacy.

One problem highlighted in the above scenarios is that the main conversation ends up being disrupted by the second conversation or an important or necessary conversation has to be deferred until a later time. Another problem highlighted in the above scenarios is that the second conversation may not enjoy the desired or requisite level of privacy or may have to be conducted in whispers, making the second conversation more difficult for participants.

As the foregoing illustrates, a more effective technique for sound management would be useful.

SUMMARY

One embodiment of the present invention sets forth a computer-implemented method for generating auditory scenes. The method includes receiving a first auditory signal that includes multiple sound components; generating a second auditory signal that, when combined with a first sound component included in the multiple sound components, attenuates the first sound component; selecting a highly directional loudspeaker included in a set of highly directional loudspeakers based on a location of an ear of a person; and transmitting the second auditory signal to the first highly directional loudspeaker, where the first highly directional loudspeaker is configured to generate an output directed towards the ear of the person based on the second auditory signal.

Further embodiments provide, among other things, a system and a non-transitory computer-readable medium configured to implement the method set forth above.

At least one advantage of the disclosed techniques is that participants in a group may engage in multiple conversations while maintain appropriate privacy for each conversation and reducing or eliminating disruption to other conversations. As a result, important conversations are not deferred and multiple conservations are accommodated without the need to find separate physical space to accommodate each separate conversation. Additionally, by aligning the orientation of the highly directional loudspeakers with the ears of users within a listening environment, a different sound experience may be provided to each user without requiring the user to wear a head-mounted device and without significantly affecting other users within or proximate to the listening environment.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous specific details are set forth to provide a more thorough understanding of the present invention. However, it will be apparent to one of skill in the art that the present invention may be practiced without one or more of these specific details.

Auditory Scene Generation System

Figure 1:
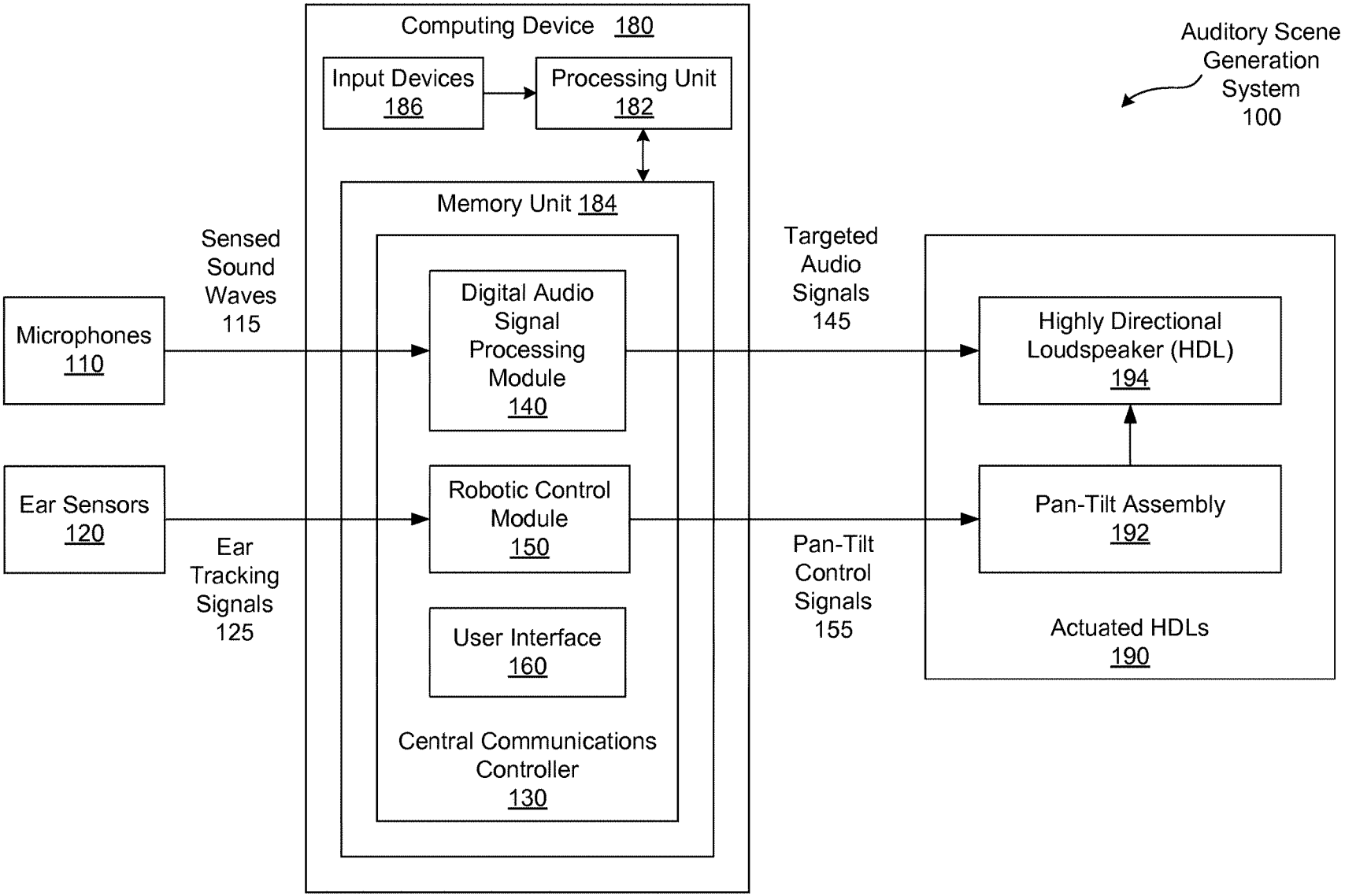
FIG. 1 illustrates an auditory scene generation system configured to implement one or more aspects of the various embodiments.

FIG. 1 illustrates an auditory scene generation system 100 configured to implement one or more aspects of the various embodiments. More specifically, the auditory scene generation system 100 facilitates the generation of one or more listening environments, also referred to herein as "auditory scenes" or "auditory bubbles."

In some embodiments, and without limitation, an auditory scene may represent a listening environment within which at least one voice component corresponding to a particular person is suppressed being heard either by individuals inside the auditory scene or by people outside of the auditory scene. In one example, and without limitation, an auditory scene that includes one person could be generated such that no one else hears the person's voice. In another example, and without limitation, an auditory scene that includes one person could be generated such that the person does not hear anyone else's voice. In another example, and without limitation, an auditory scene that includes one person could be generated such that no one else hears the person's voice, and, simultaneously, the person does not hear anyone else's voice. In yet another example, and without limitation, any number of auditory scenes may be generated, where each auditory scene includes any number of people, and each auditory scene suppresses various voices that are prevented leaving or entering each auditory scene. In this manner, auditory scenes are very customizable and configurable. Accordingly, the auditory scenes described herein are merely exemplary and do not limit the scope of possible auditory scenes that may be generated, within the scope of this disclosure.

As shown, the auditory scene generation system 100 includes, without limitation, microphones 110, ear sensors 120, a computing device 180, and actuated highly directional loudspeakers (HDLs) 190. The auditory scene generation system 100 may be deployed in any physical environment, such as, and without limitation, a conference room, vehicle, etc. In general, and without limitation, the ear sensors 120 track the ears of users in the physical environment, the microphones 110 detect sounds (including voices), and the actuated HDLs 190 can be individually configured to point toward the ears of different users. These components enable a central communications controller 130 executing within the computing device 180 to project targeted audio signals 145 that include cancellation sound (from an inverted or out-of-phase audio signal) directly to users' individual ears via appropriately aligned and oriented actuated HDLs 190. In this fashion, the central communications controller 130 can create any number of auditory scenes that include any number of users in any combination.

More specifically, each of the microphones 110 may be any technically feasible type of audio transducer that is configured to receive audio signals from the physical environment and transduce those audio signals into electrical signals, shown as sensed sound waves 115, for further processing by the central communications controller 130, as described in greater detail below. The audio signals may include spoken voices from various participants in a meeting or other physical space as well as environmental audio sources such as background noise, music, street sounds, etc. The microphones 110 may be wired or wireless, located in the physical environment or included as part of a user's mobile infrastructure (e.g., part of a handheld or worn device). For example, and without limitation, the microphones 110 may be ambient microphones that are placed in the physical environment (e.g., a room, vehicle, etc.) in which the users are located. Alternatively, and without limitation, the microphones 110 may be wearable microphones (e.g., included in a wrist watch or head mounted display, attached to the body, worn as a necklace, etc.) and/or integrated into smart devices (e.g., smartphones, tablets, etc.) Several of the microphones 110 may be combined to a microphone array, in order to change directionality or other characteristics of a single transducer. The auditory scene generation system 100 may include any number of microphones 110.

Each of the ear sensors 120 may be any technically feasible type of sensor that is capable of tracking users' heads and, more specifically, users' ears. For example, the ear sensors 120 may include, without limitation and in any number and combination, red, green, and blue (RGB) imagers, cameras, depth sensors, laser-based sensors, thermal-based sensors, and the like. The ear sensors 120 transmit ear tracking signals 125 to the central communications controller 130 via middleware (not shown) that is executed by the computing device 180 and performs sensor processing to track users' ears. In general, the ear sensors 120 are distributed in the physical environment in a manner that facilitates the tracking of multiple users in likely situations. Based on the information provided by the ear sensors 120, the central communications controller 130 determines the position and orientation of each of the ears of each of the users in the physical environment.

In some embodiments, the auditory scene generation system 100 may include, without limitation, any number of other sensors in addition to or instead of the ears sensors 120. Such sensors may track any number of other characteristics of the user(s). For example, and without limitation, the auditory scene generation system 100 could include any number of sensors that analyze the visual appearance of the user to determine and/or dynamically track features such as a hairline (e.g., sideburns, etc.), facial features (e.g., eyes, nose, mouth, lips, cheeks, etc.), neck, and/or head-worn items (e.g., an earring, hat, headband, etc.). Based on the information provided by such sensors, the central communications controller 130 could determine and/or confirm the position and/or orientation of one or more of the features. The central communications controller 130 could then leverage this feature information to determine, infer, and/or confirm the position of an ear of the user. For example and without limitation, the central communications controller 130 could determine the position of an ear of a user relative to his or her unique hairline. Subsequently, using information provided by one or more sensors, the central communications controller 130 could determine, infer, and/or confirm the position and/or orientation of the ear based on the position and/or orientation of the hairline. Advantageously, under certain circumstances, the hairline of the user (or any other feature, including the features previously mentioned) may be more visible to the sensors than other features. Accordingly, tracking the position of such a feature and then determining the position of an ear of the user relative to the feature may increase the accuracy and reliability of the auditory scene generation system 100.

The computing device 180 may be any type of device capable of executing application programs, such as, and without limitation, middleware that interprets the ear tracking signals 125. For instance, and without limitation, the computing device 180 may be a processing unit, a laptop, a tablet, a smartphone, etc. The computing device 180 may be implemented, without limitation, as a stand-alone chip, such as a microprocessor, or as part of a more comprehensive solution that is implemented as an application-specific integrated circuit (ASIC), a system-on-a-chip (SoC), and so forth. Generally, the computing device 180 may be configured to coordinate the overall operation of a computer-based system, such as an audio system. In other embodiments, the computing device 180 may be coupled to, but separate from the computer-based system. In such embodiments, the computer-based system may include a separate processor that transmits data, such as the sensed sound waves 115, to the computing device 180, which may be included in a consumer electronic device, such as a personal computer, and the like. However, the embodiments disclosed herein contemplate any technically feasible system configured facilitate the generation of one or more auditory scenes.

As shown, the computing device 180 includes, without limitation, input devices 186, a processing unit 182 and a memory unit 184. The input devices 186 may include, for example, and without limitation, devices configured to receive input (such as, one or more buttons, without limitation). Certain functions or features related to an application executed by the processing unit 182 may be accessed by actuating one of the input devices 186, such as by pressing a button. As further described herein, the processing unit 182 is operable to generate one or more audio groups or "auditory bubbles" to fully or partially isolate various users from each other. The processing unit 182 may be implemented as a central processing unit (CPU), digital signal processing unit (DSP), graphics processor unit (GPU), and so forth. The memory unit 184 may include a memory module or collection of memory modules. The memory unit 184 includes, without limitation, the central communications controller 130 which is a software application for generating various auditory scene configurations that is executed by the processing unit 182.

As shown, the central communications controller 130 includes, without limitation, a user interface 160, a digital audio signal processing module 140, and a robotic control module 150. The user interface 160 enables each user to specify his or her setting, e.g., "remove my voice from all other users' auditory fields", or "put me and Jane in an audio bubble", or "cancel all noise and speech in my ears." In some embodiments, the user interface 160 may be physical, for example, and without limitation, a single button that enables or disables the removing of a single participant from the rest of the users, or a more complex UI that enables different types of modes (i.e., privacy, isolation, etc.) In alternate embodiments, the user interface 160 may be accessed in any technically feasible fashion and executed on any computing device. For example, and without limitation, the user interface 160 may execute on a smartphone associated with one user, a laptop computer associated with another user, and a tablet computer associated with yet another user. In yet other embodiments, without limitation, the user interface 160 is configured to respond to gestures and/or verbal commands.

The digital audio signal processing module 140 receives the sensed sound waves 115 from the microphones 110 (i.e., the sound waves from the physical environment), and creates targeted audio signals 145 for each of the actuated HDLs 190. More specifically, the digital audio signal processing module 140 creates the targeted audio signals 145 that, when received by the amplifiers that power the actuated HDLs 190, cause the actuated HDLSs 190 to create individualized auditory scenes for each user.

When generating auditory scenes, the digital audio signal processing module 140 may implement a wide variety of different audio processing algorithms to analyze and parse frequency and amplitude data associated with the sensed sound waves 115. Such algorithms are operable to suppress one or more sounds (i.e., voices, background noise, etc.) from the sensed sound waves 115 by one or more techniques. In one example, and without limitation, the digital audio signal processing module 140 could determine a portion of the sensed sound waves 115 corresponding to the one or more voices to be suppressed and generate an inversion audio signal representing the inverse signal corresponding to the one or more voices. Subsequently, the digital audio signal processing module 140 could transmit the inversion audio signal as the targeted audio signals 145 to any number of the actuated HDLs 190 (associated with the users that are to be isolated from the suppressed voices).

Notably, the auditory scene generation system 100 does not cancel a user's voice or a sound in the open sound environment, but only in the auditory perception of selected other users. For example, and without limitation, if a user is to receive all voices and sounds without any alteration, then the digital audio signal processing module 140 does not transmit the targeted audio signals 145 to the user and, consequently, the user experiences no noise cancellation.

In some embodiments, without limitation, the digital audio signal processing module 140 is configured to transmit audio signals that do not correspond to sounds in the open sound environment, such as audio signals received via an audio playback device, to the user instead of or in addition to sound cancellation signals. For example, and without limitation, the auditory scene generation system 100 could be located in a movie theater and the digital audio signal processing module 140 could generate inverted audio signals that suppress background noise (e.g., audience voices, cellphones, etc.) and then combine these inverted audio signals with the movie audio signals to create the targeted audio signals 145. Upon receiving the targeted audio signals 145, the actuated HDLs 190 provide individualized movie listening experiences that reduce performance degradation typically associated with conventional movie theatres that are attributable to, without limitation, room acoustics, seat location, and so forth.

The robotic control module 150 receives the ear tracking signals 125 and creates pan-tilt control signals 155 that point and orient the actuated HDLs 190 such that the actuated HDLs 190 target the ears of the users included in the physical environment. This tracking and orientation process is continuous—as users move within the physical environment, the robotic control module 150 receives the ear tracking signals 125 in real-time and dynamically generates the pan-tilt control signals 155 that follow the ears of each of the users. By tracking individual ears in this fashion, the robotic control system 150 enables the digital audio signal processing module 140 to transmit targeted audio signals to each individual user. Working together, the robotic control module 150 and the digital audio signal processing module 140 create auditory scenes that convey an auditory experience similar to the personalized experience facilitated by the use of headphones. However, unlike conventional personalized approaches to sound management, the auditory scene generation system 100 does not require users to wear headphones and allows users to optionally hear sounds from the surroundings.

As shown, each of the actuated HDLs 190 includes a pan-tilt assembly 192 and a highly directional loudspeaker (HDL 194). Each pan-tilt assembly 192 is individually, robotically actuated and computationally controlled via the pan-tilt control signals 155. Notably, since each of the HDLs 194 is attached or mounted to a separate pan-tilt assembly 192, the HDLs 194 may point in any number of desired directions. In general, and without limitation, the pan-tilt assembly 192 may be any device that is capable of turning and rotating the HDL 194 in any desired direction, both vertically and horizontally. Each of the pan-tilt assemblies 192 may be any type of actuator (e.g., hydraulic actuators, pneumatic actuators, etc.) and may be implemented in any technically feasible fashion, such as, without limitation, using electric and piezo motors. In some embodiments, without limitation, the ear sensors 120 may be mounted onto the pan-tilt assembly 192 that also points the highly directional loudspeakers 194.

In alternate embodiments, without limitation, the pan-tilt assembly 192 may be omitted and the actuated HDL 190 may implement any technically feasible technique to align and orient the HDL 194 with the associated ear. For example, and without limitation, the actuated HDLs 190 could be a speaker array and the central communications controller 130 could include a digital signal processing control module that, together with the actuated HDLs 190, generates a steerable sound beam.

The HDLs 194 are speakers that deliver a very narrow beam of sound and may be implemented using any highly directional loudspeaker technology. For example, in some embodiments, and without limitation, the HDLs 194 are hypersonic loudspeakers (HSS), also known as highly directional loudspeakers (HDLs). Hypersonic loudspeakers are loudspeakers that are able to emit sounds in a very narrow spatial range that is audible to one specific person in a group, but not by other people in their immediate surroundings. In operation, each of the HSSs employs ultrasound that "carries" the targeted audio signals 145 that the central communications controller 130 system wants a specific user to receive. Since ultrasound is outside the range that audible by humans, the targeted audio signals 145 are not received until the ultrasound waves hit an obstacle (such as the user' ear). In response to encountering the obstacle, the ultrasound wave drops off and the targeted audio signals 145 that were carried are "heard" by the targeted person only. More specifically, because of the direction and orientation of the HDLs 194, the targeted audio signals 145 emitted from a particular HDL 194 that is tracking a user are highly attenuated relative to other users and, consequently, may be substantially inaudible to the other users.

In some embodiments, to convey the targeted audio signals 145 to specific users, the HDLs 194 generate a modulated sound wave that includes two ultrasound waves. One ultrasound wave serves as a reference tone (e.g., a constant 200 kHz carrier wave), while the other ultrasound wave serves as a signal, which may be modulated between about 200,200 Hz and about 220,000 Hz. Once the modulated sound wave strikes an object (e.g., a user's head), the ultrasound waves slow down and mix together, generating both constructive interfere and destructive interference. The result of the interference between the ultrasound waves is a third sound wave having a lower frequency, typically in the range of about 200 Hz to about 20,000 Hz. In some embodiments, an electronic circuit attached to piezoelectric transducers constantly alters the frequency of the ultrasound waves (e.g., by modulating one of the waves between about 200,200 Hz and about 220,000 Hz) in order to generate the correct, lower-frequency sound waves when the modulated sound wave strikes an object. The process by which the two ultrasound waves are mixed together is commonly referred to as "parametric interaction."

In general, the HDLs 194 may be implemented in any technically feasible fashion. In various embodiments, without limitation, the HDLs 194 may be based on regular audible frequencies or the HDLs 194 may employ modulated ultrasound. Further, the HDLs 194 may be implemented using any type of form factor, such as, without limitation, planar, parabolic, array, and the like. In some embodiments, without limitation, the HDLs 194 may be speakers using parabolic reflectors or other types of sound domes. In yet other embodiments, without limitation, the HDLs 194 may be parabolic loudspeakers (e.g., multiple speaker drivers arrayed on the surface of a parabolic dish).

Various components included in the auditory scene generation system 100 may communicate in any technically feasible fashion in any combination. For example, some embodiments, without limitations, include wireless transceivers configured to establish wireless communication links with other wireless devices, including, without limitation, a WiFi™ transceiver, a Bluetooth transceiver, an RF transceiver, and so forth. In such embodiments, the wireless transceivers may be configured to establish wireless links between, without limitation, the central communications controller 130, the microphones 110, the ear sensors 120, and the actuated HDLs 190 in any combination.

Persons skilled in the art will understand that the specific implementation of auditory scene generation system 100 are for exemplary purposes only, and not meant to limit the scope of the present invention. In practice, the auditory scene generation system 100 may be implemented by a wide variety of different combinations of hardware and software. For example, and without limitation, the central communications controller 130 could be implemented by an integrated circuit configured to perform the functionality described above, without limitation. In another example, and without limitation, the central communications controller 130 could be implemented by a system-on-chip configured to perform that functionality, without limitation. As a general matter, any device configured to perform the functionality of the central communications controller described herein falls within the scope of the present invention. Similarly, the digital audio signal processing module 140 may be configured to perform any technically feasible approach for removing one or more sounds from an input audio signal.

Figure 2:
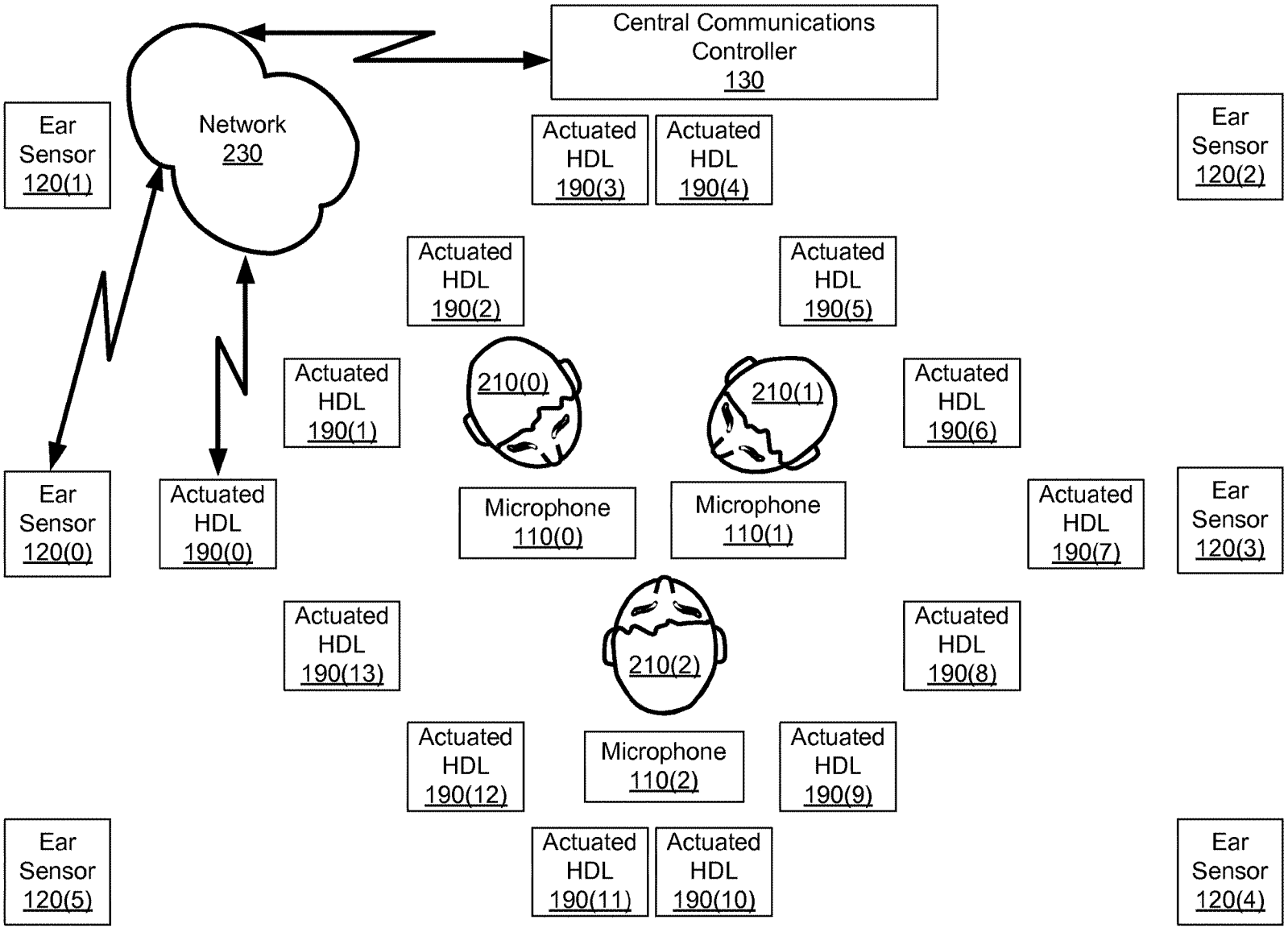
FIG. 2 illustrates how the central communications controller of FIG. 1 generates auditory scenes, according to various embodiments.

FIG. 2 illustrates how the central communications controller 130 of FIG. 1 generates auditory scenes, according to various embodiments. As shown, the central communications controller 130 communicates, without limitation, with the ear sensors 120(0)-120(5), the microphones 110(0)-110(2), and the actuated HDLs 190(0)-190(13) over a network 230. The network 230 may be established in any technically feasible communication method, such as using wireless transceivers. Alternatively, and without limitation, the central communications controller 130 may directly connect to any number of the ear sensors 120, the microphones 110, and the actuated HDLs 190 in any combination.

As detailed previously herein, the actuated HDLs 190 are physically moveable loudspeakers that generate sound wave patterns with a relatively high degree of directivity (narrowness), rather than the more typical omnidirectional sound wave pattern generated by conventional loudspeakers. Consequently, a given actuated HDL 190 may direct sound at a particular user 210, such that the user 210 hears the sound generated by the actuated HDL 190, but another user 210 sitting just to the left or just to the right of the user 210 does not hear the sound generated by the actuated HDL 190. For example, and without limitation, the actuated HDL 190(1) and the actuated HDL 190(2) could be configured to direct sound at the right ear and left ear, respectively, of the user 210(0). The actuated HDL 190(5) and the actuated HDL 190(6) could be configured to direct sound at the right ear and left ear, respectively, of the user 210(1). The actuated HDL 190(10) and actuated HDL 190(11) could be configured to direct sound at the right ear and left ear, respectively, of the user 214(2). Although fourteen actuated HDLs 190(0)-190(13) are shown, any technically feasible quantity of actuated HDLs 190 may be employed, to accommodate any technically feasible quantity of the users 2102, within the scope of this disclosure. Similarly, although six ear sensors 120 and three microphones 110 are shown, any technically feasible quantity of ear sensors 120 and microphones 110 may be employed, to accommodate any technically feasible quantity of the users 210 and adequately "cover" the physical environment, within the scope of this disclosure.

Controlling Highly Directional Loudspeakers

Figure 3:
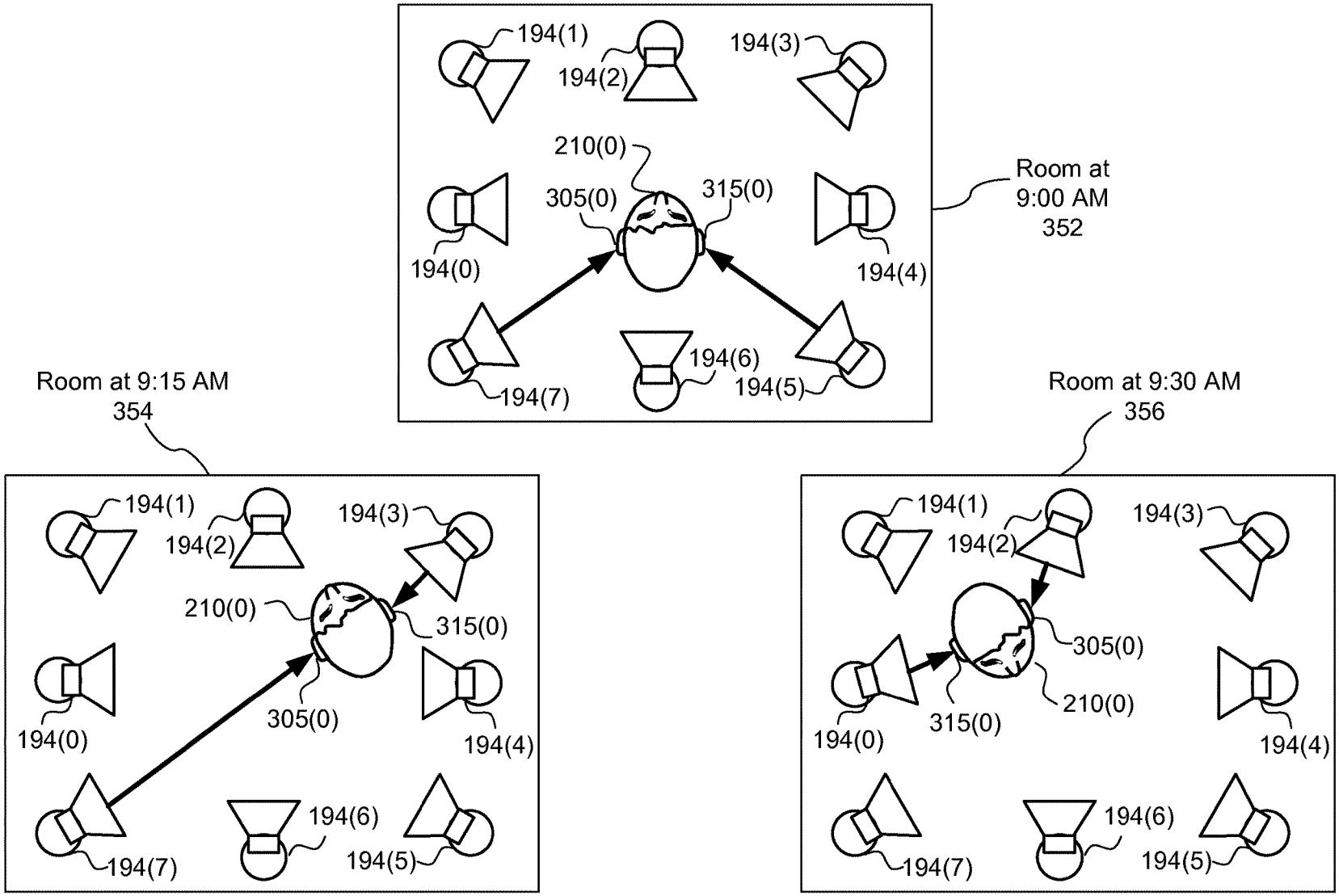
FIG. 3 illustrates how the robotic control module of FIG. 1 adjusts the highly directional loudspeakers to track user movements, according to various embodiments.

FIG. 3 illustrates how the robotic control module 150 of FIG. 1 adjusts the highly directional loudspeakers 194 to track movements of the user 210(0), according to various embodiments. For explanatory purposes, the robotic control module 150 adjusts the HDLs 194(0)-194(7) over a period of time to track the movements of the user 210. As shown, a room at 9:00 AM 352 depicts the user 210(0) in one position and orientation, a room at 9:15 AM 354 depicts the user 210(0) in a different position and orientation, and a room at 9:30 AM 356 depicts the user 210(0) in a final position and orientation.

The robotic control module 150 tracks and targets a left ear 305(0) of the user 210(0) and a right ear 315(0) of the user 210(0) separately. As the user 210(0) moves, the robotic control module 130 determines the location of the user 210(0) based on the ear sensors 150 and selects two HDLs 194. The robotic control module 130 may select the HDLs 194 in any technically feasible fashion. For example, and without limitation, in some embodiments, the robotic control module 150 may select the HDL 194 based on the distance from the HDL 194 to the ears 305. In some such embodiments, without limitation, the robotic control module 150 may select the HDL 194 that is closest to the left ear 305(0) and the HDL 194 that is closest to the right ear 315(0). In other such embodiments, without limitation, the robotic control module 150 may select the HDLs 194 that are closest to the ears 305(0)/315(0) while satisfying a constraint that reflects a minimum distance the ultrasound carrier wave requires for proper operation.

In other alternate embodiments, without limitation, the robotic control module 150 may select the HDLs 194 to optimize the path between one selected HDL 194 and the left ear 305(0) and the other selected HDL 194 and the right ear 315(0). In some such embodiments, without limitation, the robotic control module 150 may preferentially select the HDL 194 based on whether the HDL 194 has a line-of-sight with the ear 305(0)/315(0). In yet other alternate embodiments, without limitation, the robotic control module 150 may preferentially select the HDL 194 based on whether a line-of-sight between the HDL 194 and the ear 305(0)/315(0) is on-axis. Such an embodiment may reflect that sounds produced by the HDL 194 provide a better listening experience when the sounds are emitted in front of the user 210 than when the sounds are emitted behind the user 210.

Subsequently, the robotic control module 150 generates pan-tilt control signals 155 that align and orient the two selected HDLs 194 with the left ear 305(0) and the right ear 305(1) respectively. Further, the robotic control module 150 communicates with the digital audio signal processing module 140, mapping the left ear 305(0) to the HDL 194 that is pointed directly at the left ear 305(0) and mapping the right ear 315(0) to the HDL 194 that is now pointed directly at the right ear 315(0). Such communication enables the digital audio signal processing module 140 to route the targeted audio signals 145 to the appropriate HDL 194.

As shown, in the room at 9:00 AM 352, the HDL 190(7) is pointed towards the left ear 305(0) and the HDL 194(5) is pointed towards the right ear 315(0). In the room at 9:15 AM 354, the HDL 194(7) is pointed towards the left ear 305(0) and the HDL 194(3) is pointed towards the right ear 315(0). In the room at 9:30 AM 356, the HDL 194(2) is pointed towards the left ear 305(0) and the HDL 194(0) is pointed towards the right ear 315(0).

Figure 4:
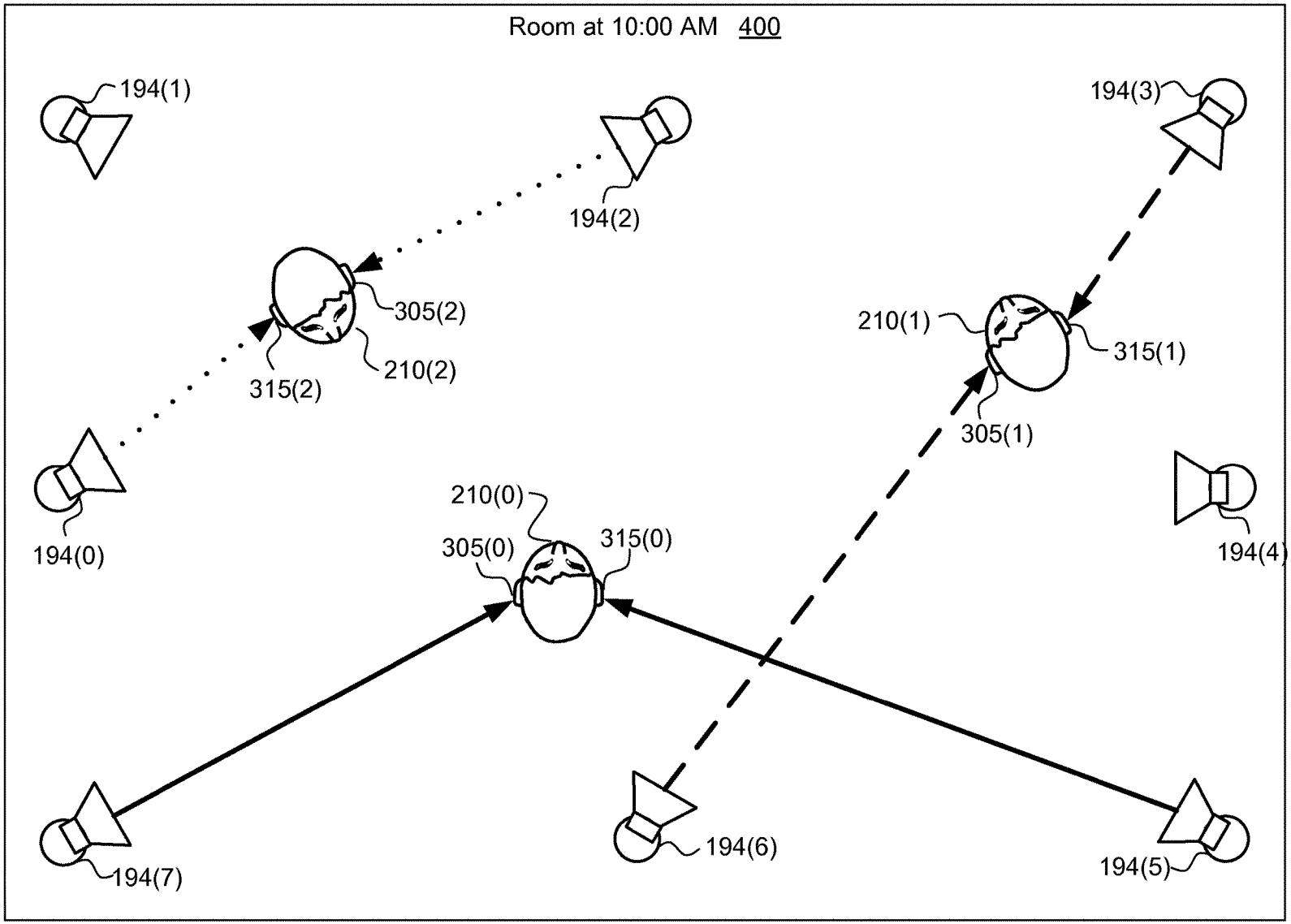
FIG. 4 illustrates how the robotic control module of FIG. 1 adjusts the highly directional loudspeakers to track multiple user movements, according to various embodiments.

FIG. 4 illustrates how the robotic control module 150 of FIG. 1 adjusts the highly directional loudspeakers 194 to track movements of multiple users 210, according to various embodiments. As shown, the robotic control module 150 directs eight HDLs 194(0)-194(7) to track and target three users 210(0)-210(2).

Notably, the robotic control module 150 independently targets the left ear 305 and the right ear 315 of each of the users 210. Consequently, the robotic control module 150 selects and aligns the orientation of the HDLs 194 with six different locations. As shown, the HDL 194(7) is pointed towards the left ear 305(0) of the user 210(0) and the HDL 194(5) is pointed towards the right ear 315(0) of the user 210(0). The HDL 194(6) is pointed towards the left ear 305(1) of the user 210(1) and the HDL 194(3) is pointed towards the right ear 315(1) of the user 210(1). The HDL 194(2) is pointed towards the left ear 305(2) of the user 210(2) and the HDL 194(0) is pointed towards the right ear 315(2) of the user 210(2). In alternate embodiments, the robotic control module 150 may track any number of ears and any number of users.

Generating Different Auditory Scenes

Figure 5:
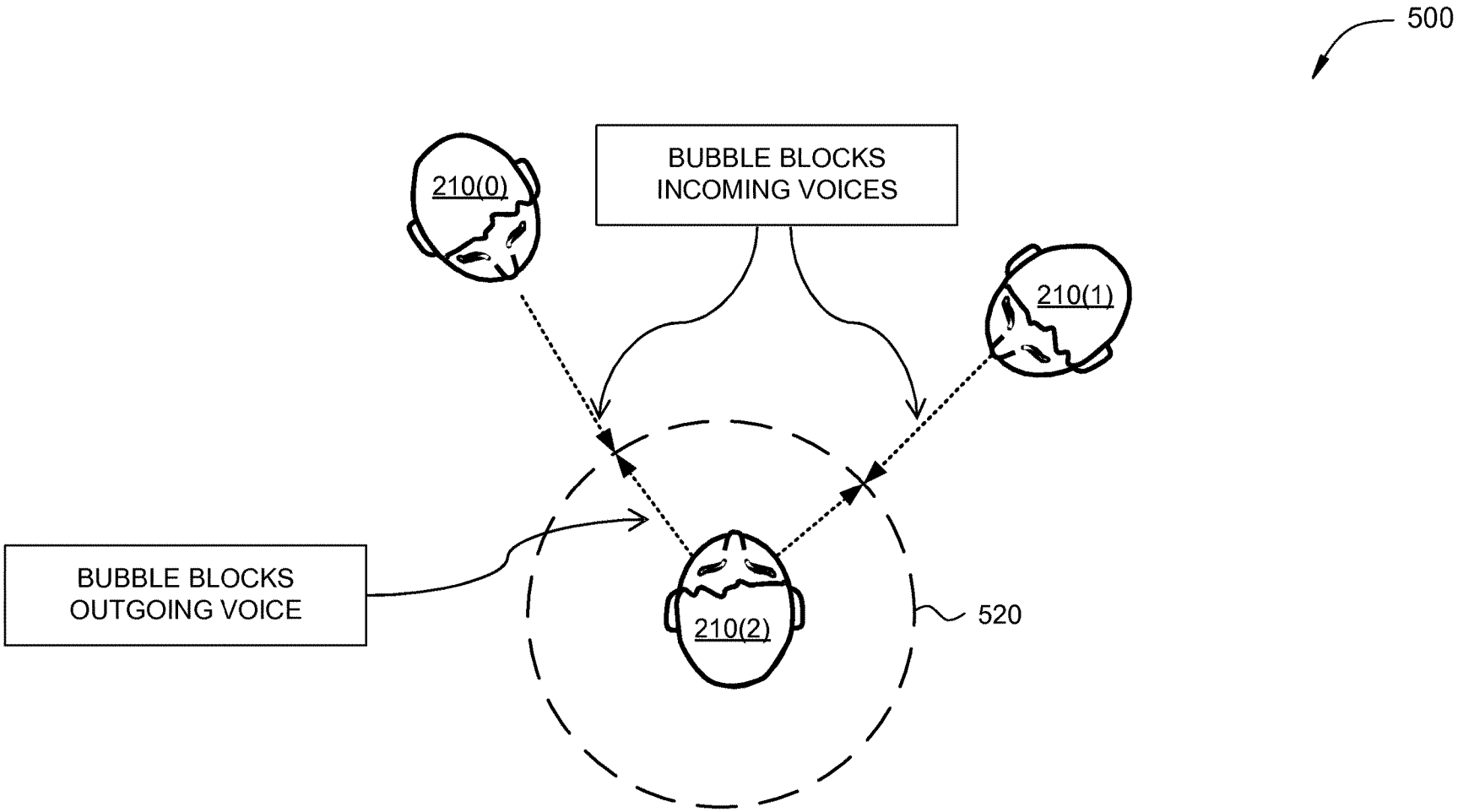
FIG. 5 illustrates an audio bubble configured to block incoming sounds and outgoing sounds, according to various embodiments.

FIG. 5 illustrates an audio bubble configured to block incoming sounds and outgoing sounds, according to various embodiments. As shown, a use case 500 includes the users 210(0), 210(1), and 210(2) and a bidirectionally isolated conversation bubble 520.

In the configuration of FIG. 5, the user 210(2) chooses to be inaudible to the users 210(0) and 210(1) and to not hear the voices of the users 210(0) and 210(1). As one example, and without limitation, the user 210(2) would choose this configuration to make a private phone call without distracting, or being distracted by, the users 210(0) and 210(1). In one example, and without limitation, this configuration could be generated when the user 210(2) wants to place or receive a mobile phone call when in a meeting or riding in a bus or taxicab.

In such cases, the digital audio signal processing unit 140 generates targeted audio signals 145 that suppress the voice components of the users 210(0) and 210(1) and, subsequently, transmits the targeted audio signals 145 to the HDL 194 that is pointed directly at the ears of user 210(2). Further, the digital audio signal processing unit 140 generates targeted audio signals 145 that suppress the voice components of the user 210(2) and, subsequently, transmits the targeted audio signals 145 to the HDLs 194 that are pointed directly at the ears of the users 210(0) and 210(1). A bidirectionally isolated conversation bubble 520 is thereby generated resulting in two auditory scenes, one that includes the user 210(2) and another that includes the users 210(0) and 210(1).

Figure 6:
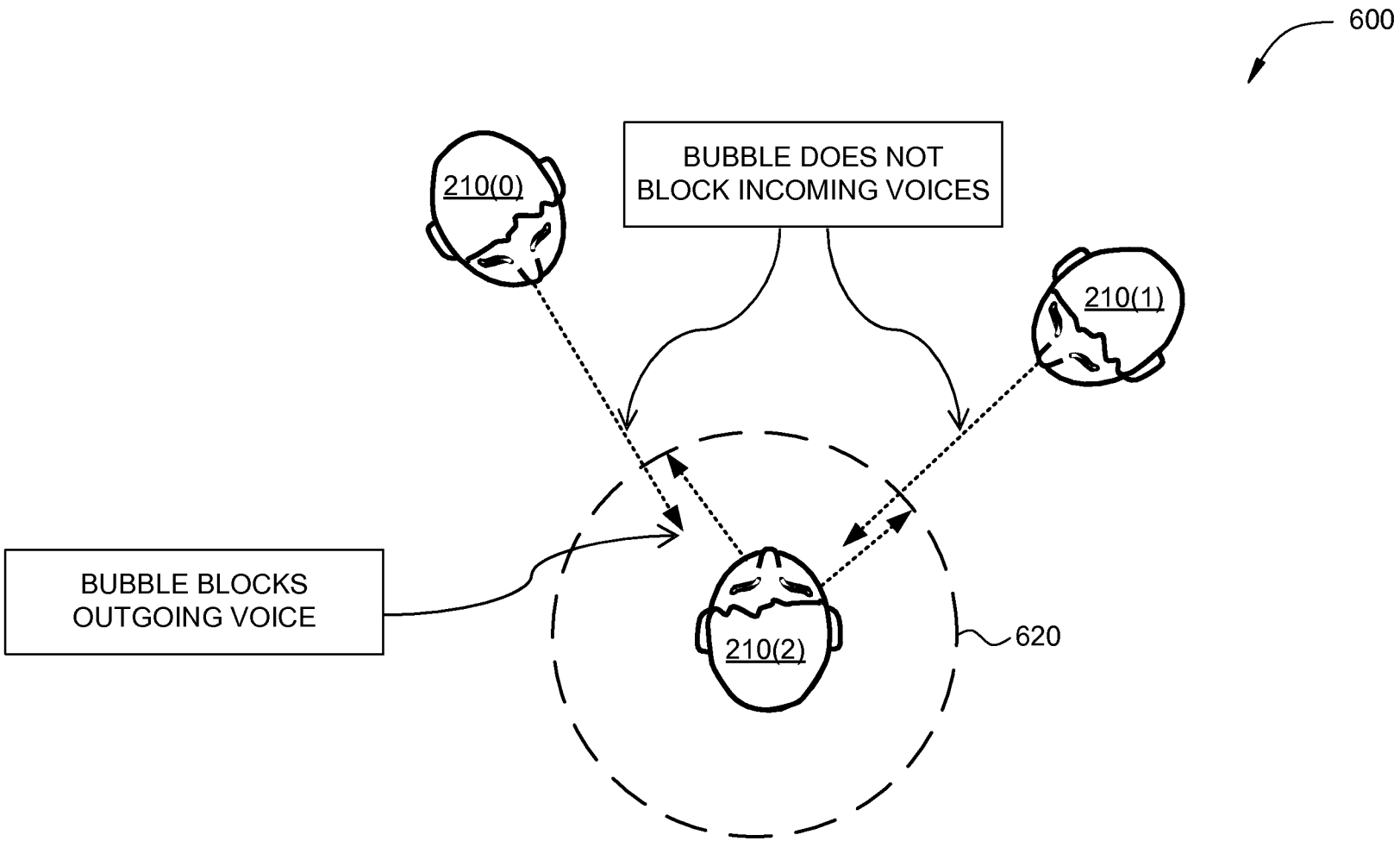
FIG. 6 illustrates an audio bubble configured to allow incoming sounds and block outgoing sounds, according to various embodiments.

FIG. 6 illustrates an audio bubble configured to allow incoming sounds and block outgoing sounds, according to various embodiments. As shown, a use case 600 includes the users 210(0), 210(1), and 210(2) and a unidirectionally outwardly isolated conversation bubble 820.

In the configuration of FIG. 6, the user 210(2) chooses to be inaudible to the users 210(0) and 210(1), but chooses to hear the voices of the users 210(0) and 210(1). In one example, and without limitation, the user 210(2) would choose this configuration to make a private phone call without distracting the users 210(0) and 210(1), but would still like to hear the conversation taking place between the users 210(0) and 210(1), such as when the user 210(2) is in a meeting or riding in a bus or taxicab.

In such cases, the digital audio signal processing unit 140 generates targeted audio signals 145 that suppress the voice components of the user 210(2) and, subsequently, transmits the targeted audio signals 145 to the HDLs 194 that are pointed directly at the ears of the users 210(0) and 210(1). A unidirectionally outwardly isolated conversation bubble 620 is thereby generated resulting in two auditory scenes, one that includes the user 210(2) and another that includes the users 210(0) and 210(1).

Figure 7:
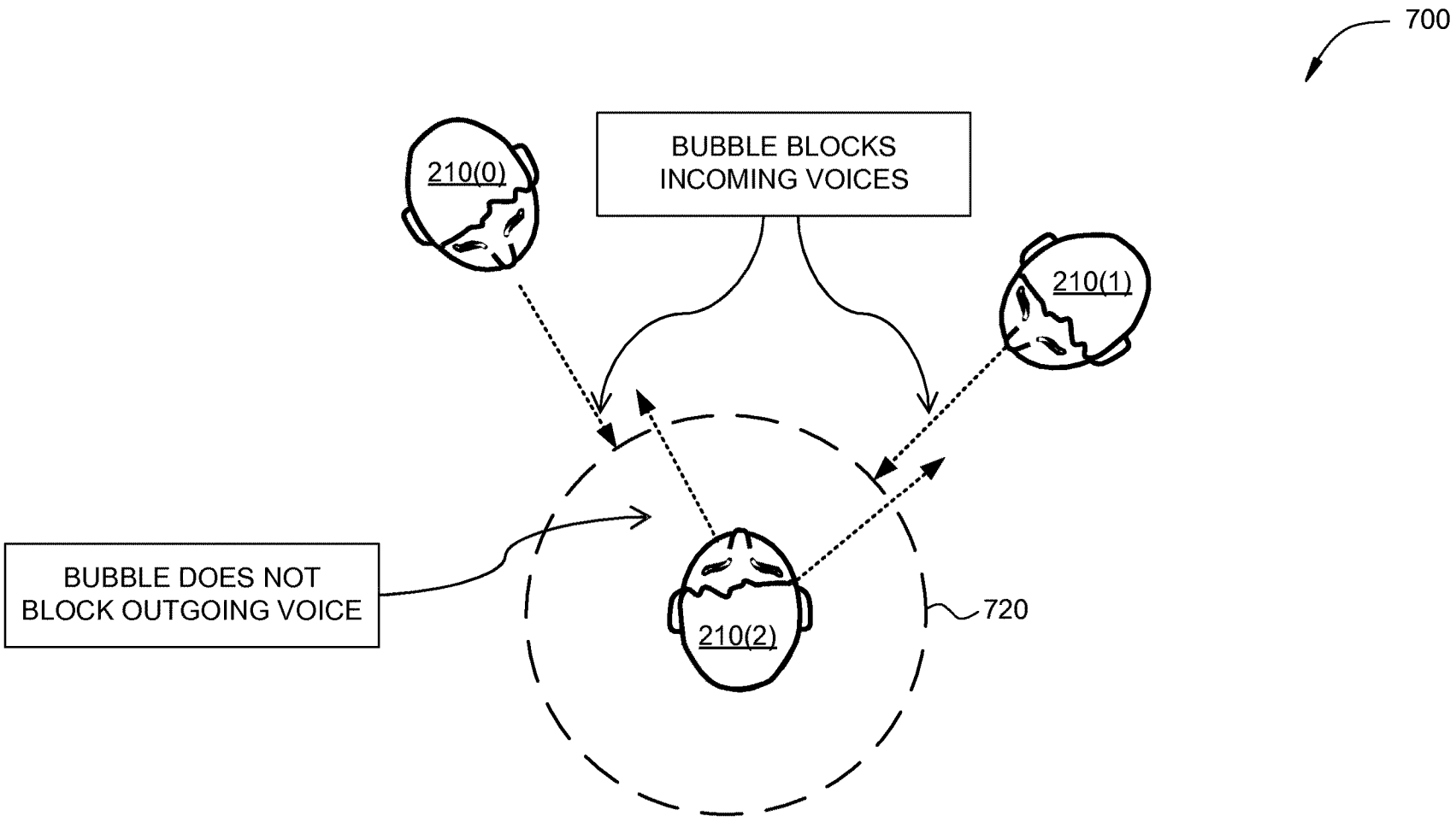
FIG. 7 illustrates an audio bubble configured to block incoming sounds and allow outgoing sounds, according to various embodiments.

FIG. 7 illustrates an audio bubble configured to block incoming sounds and allow outgoing sounds, according to various embodiments. As shown, a use case 700 includes the users 210(0), 210(1), and 210(2) and a unidirectionally inwardly isolated conversation bubble 720.

In the configuration of FIG. 7, the user 210(2) chooses to be audible to the users 210(0) and 210(1), but chooses to not to hear the voices of the users 210(0) and 210(1). In one example, and without limitation, the user 210(2) would choose this configuration to eliminate distractions from the conversation between the users 210(0) and 210(1) but would like to interject comments that the users 210(0) and 210(1) would be able to hear. In another example, and without limitation, the user 210(2) would choose this configuration to focus on replying to email or attending to other matters temporarily without distraction and does not want to leave the location where the users 210(0) and 210(1) are holding a conversation.

In such cases, the digital audio signal processing unit 140 generates targeted audio signals 145 that suppress the voice components of the users 210(0) and 210(1) either partially or fully, depending on the preferences of the user 210(2), and subsequently, transmits the targeted audio signals 145 to the HDLs 194 that are pointed directly at the ears of the user 210(2). A unidirectionally inwardly isolated conversation bubble 920 is thereby generated resulting in two auditory scenes, one that includes the user 210(2) and another that includes the users 210(0) and 210(1).

Figure 8:
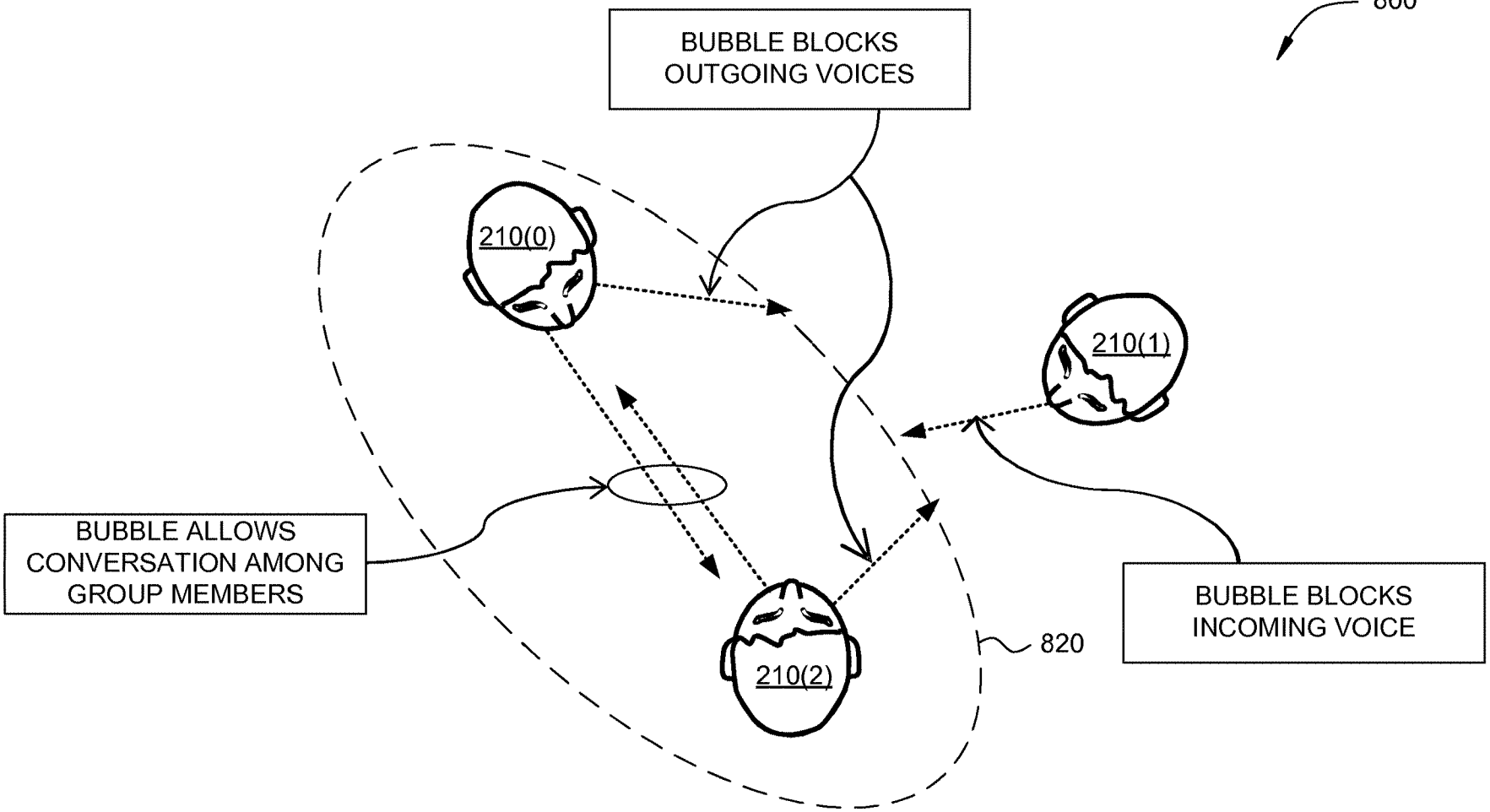
FIG. 8 illustrates an audio bubble configured to block incoming sounds and outgoing sounds and allow conversation among participants within the bubble, according to various embodiments.

FIG. 8 illustrates an audio bubble configured to block incoming sounds and outgoing sounds and allow conversation among participants within the bubble, according to various embodiments. As shown, a use case 800 includes the users 210(0), 210(1), and 210(2) and a bidirectionally isolated conversation bubble with multiple users 820.

In the configuration of FIG. 8, the users 210(0) and 210(2) choose to be inaudible to the user 210(1) and to not hear the voice of the user 210(1). In one example, and without limitation, the users 210(0) and 210(2) would choose this configuration to hold a private conversation outside of the hearing of the user 210(1). The users 210(0) and 210(2) could choose this configuration to hold a private conversation in a library or a coffee shop without distracting the user 210(1).

In such cases, the digital audio signal processing unit 140 generates targeted audio signals 145 that suppress the voice components of the users 210(0) and 210(2) and, subsequently, transmits the targeted audio signals 145 to the HDLs 194 that are pointed directly at the ears of the user 210(1). Further, the digital audio signal processing unit 140 generates targeted audio signals 145 that suppress the voice components of the user 210(1) and, subsequently, transmits the targeted audio signals 145 to the HDLs 194 that are pointed directly at the ears of the users 210(0) and 210(2). In some embodiments, without limitation, the users 210(0) and 210(2) could also choose to suppress background noise, such as when the users 210(0) and 210(2) are holding a conversation in a noisy environment. In such embodiments, the digital audio signal processing unit 140 generates targeted audio signals 145 that suppress background noise and, subsequently, transmits the targeted audio signals 145 to the HDLs 194 that are pointed directly at the ears of the users 210(0) and 210(2). A bidirectionally isolated conversation bubble with multiple users 820 is thereby generated resulting in two auditory scenes, one that includes the user 210(1) and another that includes the users 210(0) and 210(2).

Figure 9:
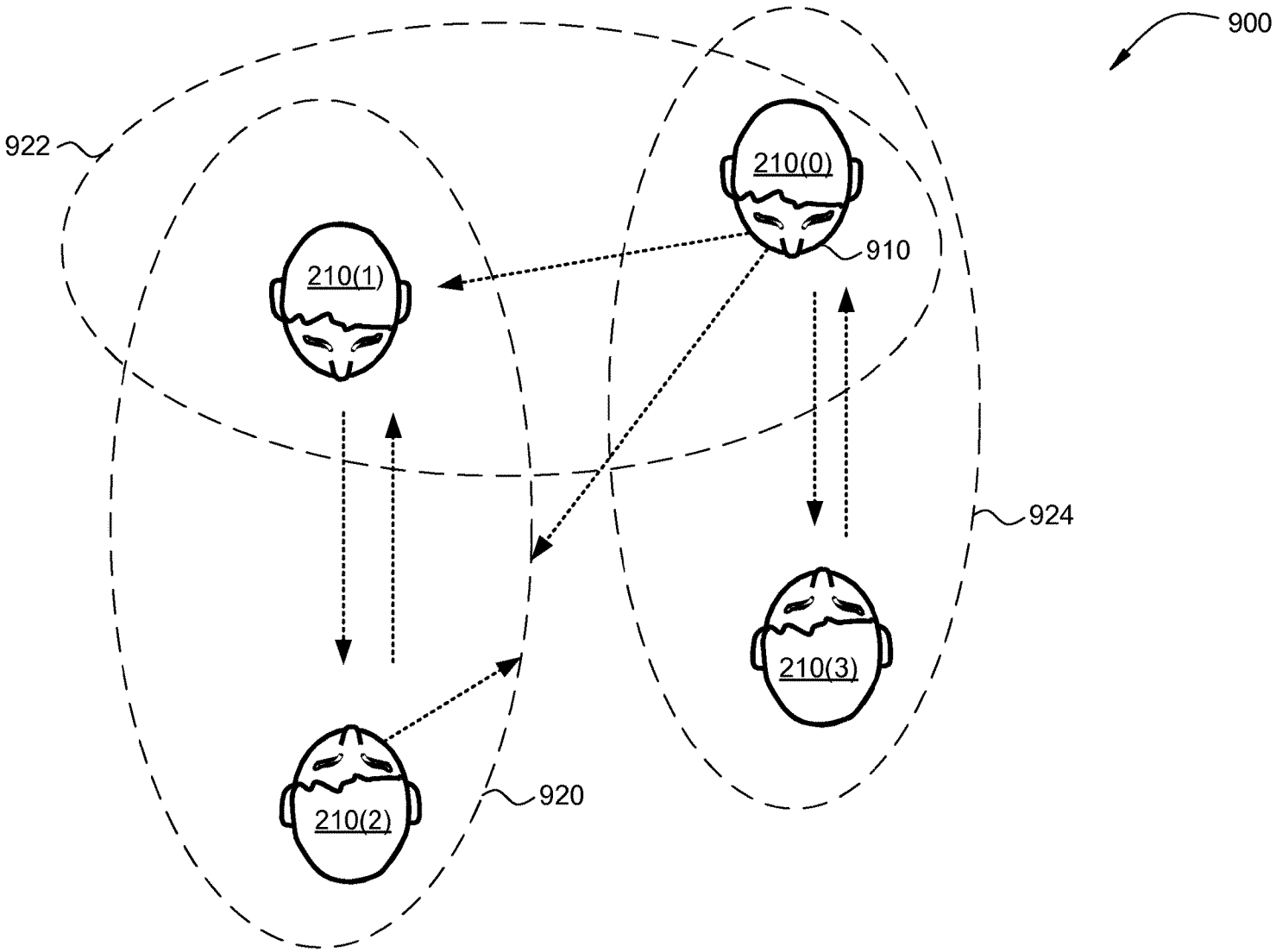
FIG. 9 illustrates a group of auditory bubbles configured to allow isolated conversations among participants within each auditory bubble, according to various embodiments.

FIG. 9 illustrates a group of auditory bubbles configured to allow isolated conversations among participants within each auditory bubble, according to various embodiments. As shown, a use case 900 includes the users 210(0), 210(1), 210(2), and 210(3) and multidirectionally isolated group auditory bubbles 920, 922, and 924.

In the configuration of FIG. 9, the users 210(0) and 210(3) would like to converse with each other, while the users 210(1) and 210(2) would like to converse with each other. In addition, the user 210(1) would like to hear the voice of the user 210(0). As one example, and without limitation, the users 210(0), 210(1), 210(2), and 210(3) would choose this configuration for situations where the user 210(0) is giving a speech in one language, while the user 210(1) is translating the speech into a second language. The user 210(3) hears the speech in the language spoken by 210(0), but does not hear the voices of the users 210(1) or 210(2). The user 210(2) hears the voice of the user 210(1), but the voice of the user 210(0) is fully or partially suppressed for the user 210(2) at the user 210(2)'s preference.

In such cases, the digital audio signal processing unit 140 generates separate targeted audio signals 145 that suppress the voice components of each of the users 210(0), 210(1), 210(2) and 210(3). Subsequently, the digital audio signal processing unit 140 selectively transmits the targeted audio signals 145 to the HDLs 194 that are pointed directly at the ears of the appropriate users 210. For example, and without limitation, the digital audio signal processing unit 140 generates targeted audio signals 145 that suppress the voice components of the users 210(0) and, subsequently, transmits the targeted audio signals 145 to the HDLs 194 that are pointed directly at the ears of the user 210(2). In this fashion, the central communications controller 130 generates multidirectionally isolated group auditory bubbles 920, 922, and 924, resulting in three auditory scenes, one that includes the users 210(0) and 210(3), another that includes the users 210(0) and 210(1), and another that includes the users 210(1) and 210(2).

Persons skilled in the art will understand that the exemplary use-case scenarios described above in conjunction with FIGS. 5-9 are provided for exemplary purposes only to illustrate different the central communications controller 130 may implement to generate various auditory scene configurations. Many other configurations of any quantity of auditory scenes, each auditory scene including any quantity of the users 210, may be implemented using the described techniques, within the scope of this disclosure. Further, the examples discussed above, although presented with reference to specific commands, devices, and operations, are not meant to limit the scope of the invention to those specificities.

Having described various use cases and systems for generating various configurations of auditory scenes, exemplary algorithms that may be implemented by central communications controller 130 are now described. By implementing the functionality described thus far, the central communications controller 130 may improve the ability of the users 210 to simultaneously conduct various conversations in the same space without interfering with each other.

Figure 10:
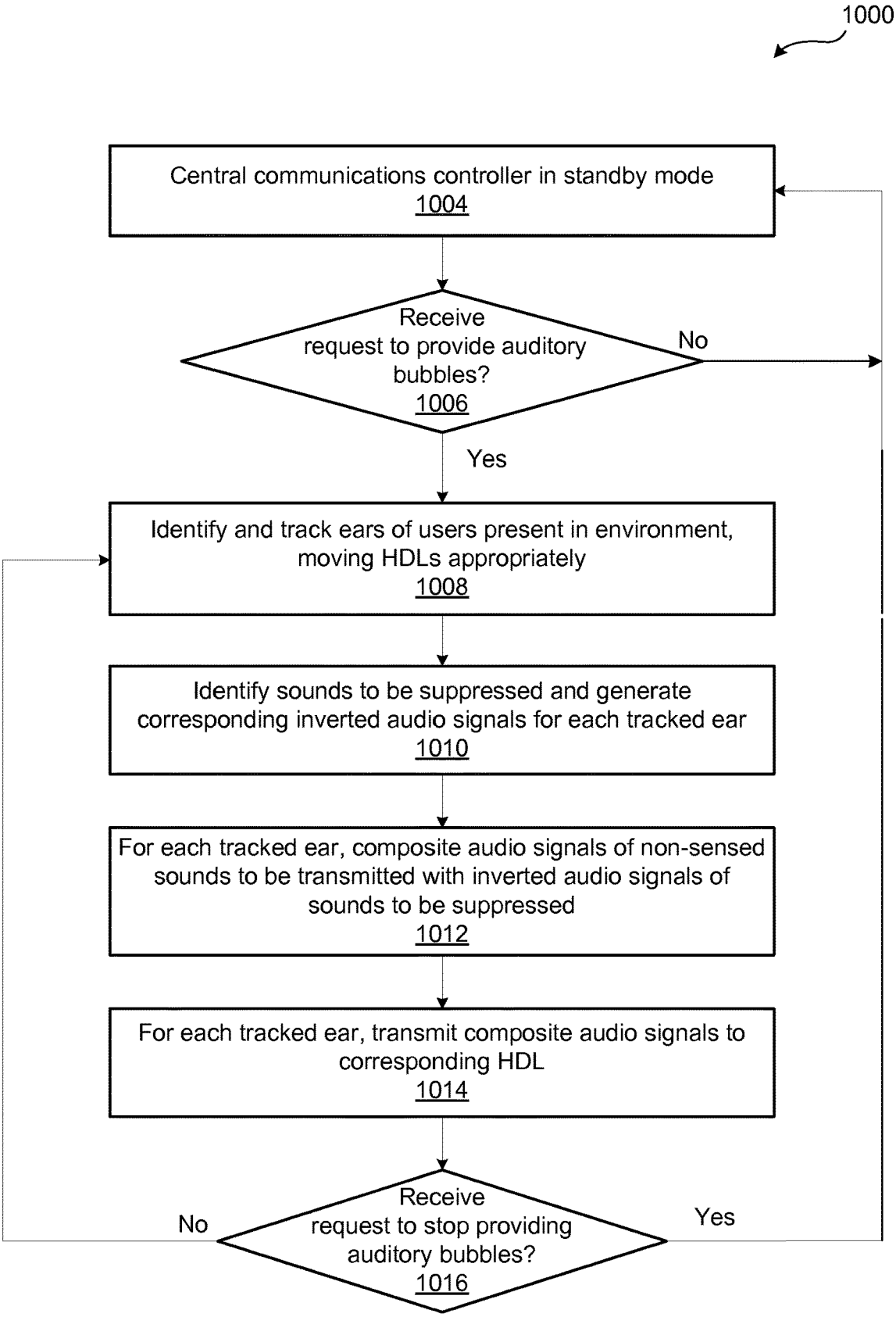
FIG. 10 is a flow diagram of method steps for generating auditory scenes, according to various embodiments.

FIG. 10 is a flow diagram of method steps for generating auditory scenes, according to various embodiments. Although the method steps are described in conjunction with the systems of FIGS. 1-9, persons skilled in the art will understand that any system configured to implement the method steps, in any order, falls within the scope of the present invention.

As shown, a method 1000 begins at step 1004, where the central communications controller 130 is in standby mode. While the central communications controller 130 is in standby mode, the users 210 hear all audio sources, perceiving the auditory environment without changes orchestrated by the central communications controller 130. At step 1006, the user interface 160 receives and processes a request and determines whether the request involves providing auditory bubbles, also referred to herein as auditory scenes. Requests that involve providing auditory bubbles may be received from any number of users 210 for any number of reasons, such as to increase privacy and/or decrease distractions. If at step 1006, the user interface 160 determines that the request does not involve providing auditory bubbles, then the method returns to step 1004 and the central communications controller 130 remains in standby. The central communications controller 130 continues in standby, cycling through steps 1004-1006 until the user interface receives a request that involves providing auditory bubbles.

If at step 1006, the user interface 160 determines that the request involves providing auditory bubbles, then the method proceeds to step 1008. At step 1008, the robotic control module 150 processes the ear tracking signals 125 to identify the location of the left ears 305 and the right ears 315 of the users 210 present in the physical environment. For each of the ears 305/315, the robotic control module 150 then selects one of the actuated HDLs 190 as the source of the targeted audio signals 145 for the ear 305/315 and generates the pan-tilt control signals 155 that cause the pan-tilt assembly 192 to align the orientation of the corresponding HDL 194 with the ear 305/315. As part of step 1008, the robotic control module 150 communicates the pairings of ears 305/315 to HDLs 194 (included in the actuated HDLs 190) to the digital audio signal processing module 140.

At step 1010, for each of the tracked ears 305/315, the digital audio signal processing module 140 identifies the sounds included in the sensed sound waves 115 to be suppressed (configured via the user interface 160) and generates corresponding inverted audio signals for the tracked ear 305/315. At step 1012, the digital audio signal processing module 140 identifies sounds that are not included in the sensed sound waves 115, but are to be transmitted, such as sounds associated with a movie that the user is watching. The digital audio signal processing module 140 then composites the audio signals of any such sounds with the inverted sounds waves of the sounds to be suppressed to create the targeted audio signals 145. In some embodiments, the digital audio signal processing module 140 may not be configured to process sources of sound that are not included in the sensed sound waves 115. In such embodiments, step 1012 may be omitted and the digital audio signal processing module 140 may transmit the inverted sound wave of the sounds to be suppressed as the targeted audio signals 145.

At step 1014, for each of the ears 305/315, the digital audio signal processing module 140 transmits the ear-specific targeted audio signals 145 to the HDL 194 that is pointed directly at the ear 305/315 for output. At step 1016, the user interface 160 receives and processes a request and determines whether the request involves ceasing to provide auditory bubbles. At step 1016, if the user interface 160 determines that the request involves ceasing to provide auditory bubbles, then the method returns to step 1004 and the central communications controller 130 returns to a standby mode. The central communications controller 130 continues in standby, cycling through steps 1004-1006 until the user interface 160 receives a request that involves providing auditory bubbles.

If at step 1016, the user interface 160 determines that the request does not involve ceasing to provide auditory bubbles, then the method returns to step 1008 and the central communications controller 130 continues to cycle through steps 1008-1016, providing auditory bubbles per the requests received via the user interface 160.

In sum, an audio scene generation system is configured to generate multiple auditory scenes in a physical environment. Notably, the central communications controller leverages highly directional loudspeakers (HDL) to provide user-specific listening experiences without imposing physical restrictions, such as wearing headsets, on users. In operation, the central communications controller receives audio "bubble" configuration requests, such as "cancel all noise and speech in my ears," "cancel my voice in the ears of Nicole but not Brandon," etc. In response, for each ear of each user, the central communications controller selectively creates cancellation signals designed to substantially attenuate the sounds targeted for suppression. Subsequently, the central communications controller selects an HDL, aligns the orientation of the HDL with the ear, and transmits the cancellation signals to the HDL for output.

At least one advantage of the disclosed approaches is that participants in a group may engage in multiple conversations while maintaining appropriate privacy for each conversation and reducing or eliminating disruption to other conversations. As a result, important conversations are not deferred and multiple conversations are accommodated without the need to find separate physical space to accommodate each separate conversation. Further, by exploiting the ability of HDLs to deliver very narrow beams of sound targeted to individual users, the disclosed approaches enable personalized sound experiences in situations, such as important meetings, that preclude the use of conventional personal audio devices, such as headphones.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The invention has been described above with reference to specific embodiments. Persons of ordinary skill in the art, however, will understand that various modifications and changes may be made thereto without departing from the broader spirit and scope of the invention as set forth in the appended claims. For example, and without limitation, although many of the descriptions herein refer to specific types of audiovisual equipment and sensors, persons skilled in the art will appreciate that the systems and techniques described herein are applicable to other types of performance output devices and sensors. The foregoing description and drawings are, accordingly, to be regarded in an illustrative rather than a restrictive sense.

While the preceding is directed to embodiments of the present disclosure, other and further embodiments of the disclosure may be devised without departing from the basic scope thereof, and the scope thereof is determined by the claims that follow.

What is claimed is:

1. A computer-implemented method for generating auditory scenes, the method comprising:

receiving a first auditory signal that includes a first plurality of sound components;

generating a second auditory signal that, when combined with a first sound component included in the first plurality of sound components, attenuates the first sound component;

selecting a first highly directional loudspeaker included in a plurality of highly directional loudspeakers by determining that the first highly directional loudspeaker has a line-of-sight with a first ear of a person and determining that a second highly directional loudspeaker included in the plurality of highly directional loudspeakers does not have a line-of-sight with the first ear of the person; and transmitting the second auditory signal to the first highly directional loudspeaker, wherein the first highly directional loudspeaker is configured to generate an output directed towards the first ear of the person based on the second auditory signal.

2. The computer-implemented method of claim 1, wherein an orientation of the first highly directional loudspeaker is controlled via a first actuator, and further comprising generating a first actuator control signal that causes the first actuator to align the orientation of the first highly directional loudspeaker with the first ear.

3. The computer-implemented method of claim 1, further comprising:

receiving a third auditory signal that includes a second plurality of sound components;

generating a fourth auditory signal that, when combined with a second sound component included in the second plurality of sound components, attenuates the second sound component;

selecting a third highly directional loudspeaker included in the plurality of highly directional loudspeakers based on a location of a second ear of the person; and transmitting the fourth auditory signal to the third highly directional loudspeaker, wherein the third highly directional loudspeaker is configured to generate an output directed towards the second ear of the person based on the fourth auditory signal.

4. The computer-implemented method of claim 1, wherein the first sound component comprises either a voice signal or a background noise signal.

5. The computer-implemented method of claim 1, further comprising, prior to selecting the first highly directional loudspeaker, receiving a first tracking signal from a sensor, and determining a location of the first ear based on the first tracking signal.

6. The computer-implemented method of claim 5, wherein the sensor is disposed proximate to the first highly directional loudspeaker.

7. The computer-implemented method of claim 1, wherein selecting the first highly directional loudspeaker is based on a distance between the first highly directional loudspeaker and the first ear.

8. A non-transitory, computer-readable storage medium including instructions that, when executed by a processor, cause the processor generate auditory scenes by performing the steps of:

receiving a first auditory signal that includes a first plurality of sound components;

generating a second auditory signal that, when combined with a first sound component included in the first plurality of sound components, attenuates the first sound component;

selecting a first highly directional loudspeaker included in a plurality of highly directional loudspeakers by determining that the first highly directional loudspeaker has a line-of-sight with a first ear of a person and determining that a second highly directional loudspeaker included in the plurality of highly directional loudspeakers does not have a line-of-sight with the first ear of the person;

causing the first highly directional loudspeaker to point at the first ear; and while the first highly directional loudspeaker is pointed at the first ear, transmitting the second auditory signal to the first highly directional loudspeaker.

9. The non-transitory, computer-readable storage medium of claim 8, further comprising, prior to generating the second auditory signal, receiving a request to suppress the first sound component.

10. The non-transitory, computer-readable storage medium of claim 8, wherein the first sound component comprises either a voice signal or a background noise signal.

11. The non-transitory, computer-readable storage medium of claim 8, further comprising, prior to selecting the first highly directional loudspeaker, receiving a first tracking signal from a sensor, and determining a location of the first ear based on the first tracking signal.

12. The non-transitory, computer-readable storage medium of claim 8, wherein selecting the first highly directional loudspeaker is based on a distance between the first highly directional loudspeaker and the first ear.

13. The non-transitory, computer-readable storage medium of claim 8, wherein selecting the first highly directional loudspeaker comprises determining that a line-of-sight between the first highly directional loudspeaker and the first ear is on-axis, and a line-of-sight between a second highly directional loudspeaker included in the plurality of highly directional loudspeakers and the first ear is off-axis.

14. The non-transitory, computer-readable storage medium of claim 8, wherein generating the second auditory signal comprises:

generating a first inverted signal based on the first sound component;

receiving a third auditory signal from a playback device; and compositing the first inverted signal and the third auditory signal.

15. The non-transitory, computer-readable storage medium of claim 14, further comprising:

selecting a second highly directional loudspeaker included in the plurality of highly directional loudspeakers based on a location of a second ear of a different person; and transmitting the third auditory signal to the second highly directional loudspeaker, wherein the second highly directional loudspeaker is configured to generate an output directed towards the second ear of the different person based on the third auditory signal.

16. A system for generating auditory scenes, the system comprising:

a memory that includes a central communications controller; and a processor coupled to the memory and, upon executing the central communications controller, is configured to:

receive a first auditory signal that includes a first plurality of sound components;

generate a second auditory signal that, when combined with a first sound component included in the first plurality of sound components, attenuates the first sound component;

select a first highly directional loudspeaker included in a plurality of highly directional loudspeakers by determining that the first highly directional loudspeaker has a line-of-sight with a first ear of a person and determining that a second highly directional loudspeaker included in the plurality of highly directional loudspeakers does not have a line-of-sight with the first ear of the person; and transmit the second auditory signal to the first highly directional loudspeaker, wherein the first highly directional loudspeaker is configured to generate an output directed towards the first ear of the person based on the second auditory signal.

17. The system of claim 16, wherein the first highly directional loudspeaker is embedded in a headrest associated with a chair or seat.

18. The system of claim 16, wherein the first highly directional loudspeaker is mounted on a drone device.

19. The computer-implemented method of claim 1, wherein selecting the first highly directional loudspeaker is further based on a distance between the first highly directional loudspeaker and the first ear.

20. The computer-implemented method of claim 1, wherein:

the first sound component comprises a first voice component, a second sound component included in the first plurality of sound components comprises a second voice component, and when combined with the first sound component, the second auditory signal attenuates the first voice component while not attenuating the second voice component.

* * * * *